US010034806B1

(12) United States Patent
Greenhalgh, Sr.

(10) Patent No.: US 10,034,806 B1
(45) Date of Patent: Jul. 31, 2018

(54) OVER-BED TABLE ORGANIZER

(71) Applicant: Samuel Greenhalgh, Sr., Aston, PA (US)

(72) Inventor: Samuel Greenhalgh, Sr., Aston, PA (US)

( * ) Notice: Subject to any disclaimer, the term of this patent is extended or adjusted under 35 U.S.C. 154(b) by 0 days.

(21) Appl. No.: 15/603,688

(22) Filed: May 24, 2017

(51) Int. Cl.

| | |
|---|---|
| ***A47G 29/087*** | (2006.01) |
| ***A61G 7/05*** | (2006.01) |
| ***A47C 21/00*** | (2006.01) |
| ***A47B 46/00*** | (2006.01) |
| ***A47B 13/16*** | (2006.01) |
| ***A47B 13/12*** | (2006.01) |
| *A47B 23/02* | (2006.01) |
| *A47F 5/00* | (2006.01) |

(52) U.S. Cl.
CPC ..... *A61G 7/05* (2013.01); *A47B 13/12* (2013.01); *A47B 13/16* (2013.01); *A47B 46/00* (2013.01); *A47C 21/00* (2013.01); *A47B 23/025* (2013.01); *A47F 5/0025* (2013.01)

(58) Field of Classification Search
CPC ..... A61G 7/05; A47C 21/00; A47B 46/00; A47B 13/16; A47B 13/12; A47B 23/025
USPC ..... 211/4, 11, 40, 119.005, 119.003, 211/69.1–69.4, 69, 65; 312/245, 351; 108/25, 91, 90; 70/78–82, 85–87
See application file for complete search history.

(56) References Cited

U.S. PATENT DOCUMENTS 254,836 A * 3/1882 Nauerth ..... A47F 7/148 206/425
460,748 A * 10/1891 Hartmann ..... A47B 7/02 108/91
535,782 A * 3/1895 Woodruff ..... E05B 65/462 312/217
648,928 A * 5/1900 Davis ..... A61L 2/00 206/207
742,581 A * 10/1903 Burtch ..... A47K 1/09 211/65
857,763 A * 6/1907 Smith ..... B25H 3/003 211/205
985,924 A * 3/1911 Nelson ..... A47B 57/16 108/109
1,047,366 A * 12/1912 Alston ..... A47F 7/024 211/4
1,092,156 A * 4/1914 Mathis ..... A61L 2/00 131/256
1,246,536 A * 11/1917 Bristol ..... B25H 3/003 211/69

(Continued)

FOREIGN PATENT DOCUMENTS

CN 105310271 * 2/2016

*Primary Examiner* — Jonathan Liu
*Assistant Examiner* — Devin K Barnett
(74) *Attorney, Agent, or Firm* — Robert J. Yarbrough; Lipton, Weinberger & Husick

(57) ABSTRACT

An organizer for an over-bed table includes left and right sides that support an organizer top. One or more shelves selectably engage opposing slots defined by the left and right sides. A plurality of holes penetrate the organizer top and are configured to receive pins in a user-selectable configuration. The pins extend above the organizer top to support an object to be supported in a generally upright position. The amount by which the pins extend above the organizer top is determined by the selectable engagement of the shelves and the opposing slots defined by the left and right sides.

17 Claims, 13 Drawing Sheets

(56) References Cited

U.S. PATENT DOCUMENTS 1,268,509 A * 6/1918 Stone ..... A47B 47/03 292/162
1,463,805 A * 8/1923 Faber ..... A47F 7/0028 211/69.1
1,544,920 A * 7/1925 Manley ..... B42F 7/12 211/11
1,662,077 A * 3/1928 Schwartz ..... B43M 99/00 211/69.1
1,833,081 A * 11/1931 Kilmer ..... B65D 25/06 217/36
1,839,291 A * 1/1932 Barbour ..... A47B 23/00 248/455
2,117,459 A * 5/1938 Stanton ..... A47K 1/09 131/256
2,130,197 A * 9/1938 Schick ..... A47F 7/0007 211/49.1
2,563,718 A * 8/1951 Gifford ..... G21F 5/015 250/506.1
2,572,333 A * 10/1951 Greitzer ..... A47B 1/05 108/90
2,604,557 A * 7/1952 Nelson ..... F21V 23/0414 200/61.59
D169,077 S * 3/1953 Mains ..... 211/65
2,637,299 A * 5/1953 Salkey ..... A45C 11/34 206/214
D171,677 S * 3/1954 Adler ..... 211/40
2,766,092 A * 10/1956 Dennison ..... F16B 12/18 211/186
2,844,429 A * 7/1958 Frey ..... A47B 23/002 108/115
2,879,561 A * 3/1959 Rieder ..... 108/180
2,959,296 A * 11/1960 Case ..... B43K 23/001 211/69.1
3,033,634 A * 5/1962 Ribbens ..... E05B 65/003 292/122
3,181,483 A * 5/1965 Devitt ..... A47B 23/00 108/159
3,236,366 A * 2/1966 Broda ..... B25H 3/003 206/379
3,285,429 A * 11/1966 Propst ..... A47B 57/586 211/184
3,349,937 A * 10/1967 Duff ..... B01L 3/0293 206/305
3,403,641 A * 10/1968 Baker ..... A47B 47/042 108/152
3,478,892 A * 11/1969 Lockwood ..... A47B 87/00 108/91
3,570,679 A * 3/1971 Edson ..... A47F 7/163 108/1
3,675,955 A * 7/1972 Hajduk ..... F16B 12/26 217/12 R
3,730,605 A * 5/1973 Eckard ..... A47B 67/04 211/184
3,856,374 A * 12/1974 Christen ..... A23B 4/052 219/392
4,030,250 A * 6/1977 Walker ..... B24B 7/08 451/282
4,057,244 A * 11/1977 Gaspar ..... A47B 83/02 108/25
4,122,780 A * 10/1978 Brickman ..... A47B 3/02 108/25
4,125,304 A * 11/1978 Ebert ..... A47B 47/042 312/257.1
4,181,382 A * 1/1980 Harvey ..... A47B 95/008 108/152
D254,887 S * 5/1980 Jorda-Segui ..... D6/675.1
4,236,460 A * 12/1980 Poupko ..... A47B 43/00 108/162
4,418,627 A * 12/1983 Baker ..... A47B 87/0253 108/157.13
4,463,684 A * 8/1984 Klungle ..... A47B 43/00 108/91
4,465,329 A * 8/1984 Haas ..... E05B 65/467 211/4
4,469,231 A * 9/1984 Hehn ..... B42F 15/0094 108/180
4,485,930 A * 12/1984 Savelkouls ..... A47B 73/006 108/53.3
4,531,645 A * 7/1985 Tisbo ..... A47F 5/02 211/126.15
4,576,423 A * 3/1986 Hendriks ..... E05B 65/467 211/4
4,616,754 A * 10/1986 Heinzl ..... B65D 11/10 211/126.15
4,709,640 A * 12/1987 Jouanin ..... A47B 47/0041 108/181
4,713,949 A * 12/1987 Wilcox ..... A47B 45/00 108/102
4,773,544 A * 9/1988 McCarthy ..... B43K 23/002 206/214
4,830,440 A * 5/1989 Burch ..... A47B 17/00 108/152
4,841,881 A * 6/1989 Battistella ..... A23L 3/364 108/91
4,863,042 A * 9/1989 Rohner ..... B42F 7/12 211/11
4,880,122 A * 11/1989 Martindell ..... B25H 3/003 206/374
4,892,043 A * 1/1990 Schulz ..... B25H 1/02 108/90
4,949,853 A * 8/1990 Klein ..... A47B 47/02 108/180
4,972,947 A * 11/1990 McCarthy ..... B43M 99/006 206/214
5,080,453 A * 1/1992 Miller ..... B63B 29/04 312/245
D332,647 S * 1/1993 Johnson ..... D21/671
D333,579 S * 3/1993 Wells ..... D6/407
5,249,857 A * 10/1993 Suzuki ..... A47B 47/042 312/249.8
D342,585 S * 12/1993 Fischbach ..... D28/38
5,314,077 A * 5/1994 Theosabrata ..... A47B 81/068 211/40
5,358,112 A * 10/1994 Gardner ..... A61C 3/04 206/369
5,419,628 A * 5/1995 Myslinski, Jr. ..... A47B 7/0075 16/252
D359,862 S * 7/1995 Rousch ..... D12/419
5,464,348 A * 11/1995 Fischer ..... A61C 19/10 206/369
5,535,682 A * 7/1996 Aigeldinger ..... A47B 3/08 108/129
5,542,758 A * 8/1996 Brown ..... A47B 61/00 211/1.3
5,634,563 A * 6/1997 Peng ..... G11B 33/0483 206/308.1
5,651,152 A 7/1997 Ritchie
5,707,124 A * 1/1998 Johnson ..... A47B 81/068 206/308.1
5,724,894 A * 3/1998 Knorovsky ..... A47B 81/002 108/42
5,740,924 A * 4/1998 Hunt ..... A47B 81/068 206/308.1
5,803,563 A * 9/1998 Woodward ..... E06B 9/115 160/37
5,829,590 A * 11/1998 Klein ..... A61C 3/04 206/369
5,878,882 A * 3/1999 Kohagura ..... B25H 3/003 206/379
D408,058 S * 4/1999 Isaacs ..... D19/75
5,983,420 A * 11/1999 Tilley ..... A47B 13/02 108/91
6,007,167 A * 12/1999 Cohen ..... G11B 33/0483 206/387.15
6,030,059 A * 2/2000 Stravitz ..... A47B 63/00 206/387.14
6,102,216 A * 8/2000 Frank ..... A47B 61/00 211/126.15

(56) References Cited

U.S. PATENT DOCUMENTS 6,148,736 A * 11/2000 Erbs ..... A47B 87/0253 108/101
6,155,435 A * 12/2000 Malik ..... A47B 57/26 108/64
6,279,753 B1 * 8/2001 Swanson ..... F21V 33/002 211/1.51
6,354,447 B1 * 3/2002 Brown ..... A45D 44/005 132/73
6,508,369 B2 * 1/2003 Wang ..... A47F 7/0028 211/60.1
6,655,762 B2 * 12/2003 Krueger ..... E05B 63/0056 312/330.1
6,675,978 B2 * 1/2004 Shea ..... A47F 5/0823 211/181.1
6,708,604 B1 * 3/2004 Deichler, Jr. ..... A47J 37/0763 126/25 R
6,759,012 B2 * 7/2004 Haslam ..... B01J 19/0046 101/93.04
D504,567 S * 5/2005 Peterson ..... D3/305
7,516,704 B2 * 4/2009 Snider ..... B25H 1/04 108/25
7,658,267 B1 * 2/2010 Welsh ..... B23C 11/22 108/25
D633,733 S * 3/2011 Riedel ..... D6/678.1
7,967,137 B2 6/2011 Fulbrook
7,984,815 B2 * 7/2011 Lynch ..... A47B 47/00 211/186
8,051,783 B1 * 11/2011 Hoskinson ..... A47B 37/00 108/23
8,118,375 B2 * 2/2012 Berthiaume ..... A47B 9/14 108/147.21
D670,112 S * 11/2012 Malone ..... D6/514
8,444,235 B2 * 5/2013 Gmerek ..... A47F 5/0838 248/225.21
8,695,795 B1 * 4/2014 Huber ..... A47B 87/0292 206/308.1
9,138,052 B2 * 9/2015 Kagramanyan ..... A47B 61/00
D757,176 S * 5/2016 Tsai ..... D19/92
9,578,960 B1 * 2/2017 Wu ..... A47B 21/0314
2001/0032824 A1 * 10/2001 LaFontaine ..... A47B 47/00 211/10
2003/0196976 A1 * 10/2003 Gervasi ..... A47F 3/004 211/153
2003/0234230 A1 * 12/2003 Wang ..... A47F 7/0028 211/70.6
2004/0016710 A1 * 1/2004 Kjelgaard ..... B43M 99/006 211/69.5
2004/0103827 A1 * 6/2004 Cho ..... A47B 83/045 108/90
2004/0107878 A1 * 6/2004 Podd ..... A47B 23/001 108/25
2004/0188367 A1 * 9/2004 Pleiman ..... B25H 3/04 211/70.6
2005/0199562 A1 * 9/2005 Yu ..... A47B 81/068 211/40
2006/0180559 A1 * 8/2006 Roberti ..... B44D 3/12 211/65
2007/0056916 A1 * 3/2007 Marano ..... A47B 49/00 211/10
2007/0235395 A1 * 10/2007 Mondale ..... A46B 1/09 248/311.2
2008/0000399 A1 * 1/2008 Herbert ..... A47F 3/005 108/90
2011/0155021 A1 * 6/2011 Geitner ..... A47B 3/08 108/25
2011/0155022 A1 * 6/2011 Rochel ..... A47B 23/00 108/25
2011/0197796 A1 8/2011 Bhave
2012/0098396 A1 * 4/2012 Schinzing ..... A47B 45/00 312/245
2013/0061781 A1 * 3/2013 Wong ..... B60N 3/002 108/3
2013/0074742 A1 * 3/2013 Hsieh ..... A47B 23/06 108/49
2014/0070061 A1 * 3/2014 Tsai ..... A47D 1/008 248/205.1
2015/0068433 A1 * 3/2015 Nardi ..... A47B 13/16 108/25
2015/0289641 A1 * 10/2015 Ergun ..... A47B 9/16 108/42
2016/0058249 A1 * 3/2016 Pitman ..... A47K 1/09 248/311.2
2016/0138300 A1 * 5/2016 Dias ..... E05B 65/46 70/85

* cited by examiner

OVER-BED TABLE ORGANIZER

I. BACKGROUND OF THE INVENTION

A. Field of the Invention

The Invention is an organizer for use with an over-bed table. The Invention is particularly useful for a person who is confined to bed. The organizer of the Invention allows a person who is confined to bed to readily access items that the person may need.

B. Statement of the Related Art

Persons who are confined to bed have limited mobility. Such persons can access materials, supplies, personal care items, meals, reading material, writing utensils, a tablet or laptop computer, diversions, and anything else the person may need only if those things are within easy reach of the person. In the usual hospital or extended care facility, such a person may have access to an over-bed table, which is a table that extends over the top of the bed so that the table top is directly in front of the person confined to the bed. U.S. Patent Publication 2011/0197796 by Bhave, published Aug. 18, 2011, teaches an example of an over-bed table. The person confined to bed has access only to the portion of the tabletop that is within the person's reach, which provides a limited area on which to place, store and use the materials that the person needs while confined to the bed.

Organizers are known in the art, including organizers for use with hospital beds. For example, U.S. Pat. No. 5,651,152 to Ritchie issued Jul. 29, 1997 teaches an organizer having pockets that attaches to the rail of a hospital bed. As a second example, U.S. Pat. No. 7,967,137 to Fulbrook, issued Jun. 28, 2011, that teaches an organizer tray for expendable medical supplies.

The prior art does not teach the organizer of the Invention.

II. BRIEF DESCRIPTION OF THE INVENTION

The Invention includes upstanding left and right sides joined by a back. An organizer top is supported in a horizontal position by the left and right sides. The organizer top may extend laterally beyond the left and right sides to define a working surface. Sliding shelves may selectably engage corresponding horizontal slots in the left and right sides, allowing a user to configure the arrangement of shelves to his or her liking. When not in use, the shelves may be stored in vertical opposing slots defined by the left and right sides and located between the organizer top and the back.

A plurality of holes penetrates the organizer top. Each hole is configured to receive an elongated pin. The pin may be cylindrical and may be in the shape of a dowel. A conventional wooden pencil may act as the elongated pin. The pins may be composed of any suitable material, such as wood, plastic or metal.

If a shelf is in engagement with the horizontal slots in the left and right sides, downward movement of the pin through the hole is stopped by the shelf or by any object that is supported by the shelf. The user therefore may control the amount by which the pins extend above the organizer top by selecting the configuration of the shelves. The fit between the pin and the hole through the organizer top is selected so that the organizer top will maintain the pin in a generally upright position when the pin penetrates the hole.

The number and location of the holes are selected to allow a person to install a plurality of pins in a spaced-apart relation in the 'X' and 'Y' directions. The person may thus form a grid of pins extending above the organizer top. The elongated pins extend above the organizer top by a sufficient amount to support a book, folder, tablet computer or other object in a generally upright position between opposing pins. As noted, the person may select the amount by which a pin extends above the organizer top by selecting the configuration of the shelves.

The person may arrange the grid of pins so that a book, tablet computer, folder or other object can be supported by the pins and oriented in the 'X' direction. Alternatively, the person may arrange the grid of pins so that the book, tablet computer, folder or other object is oriented in the 'Y' direction, or in a direction oblique to the 'X' and 'Y' directions. Because the pins are removable and the locations of the pins are selectable by the user, the user need use only the number and locations of pins that are needed for the user's particular application. The remainder of the organizer top is thus available for other uses, for example as a writing surface or to support a food tray.

The organizer top may also define cup openings penetrating the organizer top and configured to receive and support one or more cups. A cup within a cup opening may store the elongated pins when the elongated pins are not penetrating the holes and are not supporting an object to be supported on the organizer top.

The left and rights sides in cooperation define a front stop. The front stop is configured to engage the front edge of the over-bed table and to prevent the organizer from sliding on the over-bed table in a first direction away from the person in the bed. The back or left and right sides may define a rear stop to engage the top of the over-bed table and to prevent unintended movement of the organizer in a direction opposite to the first direction.

The left and right sides, back, top and shelves may be composed of any suitable material, but acrylic, particularly clear acrylic is believed to be suitable. Acrylic has the benefit of ready disinfection in the healthcare setting. Clear acrylic has the added benefit that the person confined to bed can see through the organizer to locate stored objects with a minimum of effort. The left and right sides and back may be a 'wrap' composed of a single piece of acrylic that is formed into a U-shape. The top may be bonded to the left and right sides, as by an adhesive or by thermal or solvent welding.

The organizer may include an elongated lock to selectably tie one or more shelves to the organizer top. The elongated lock engages a lock mating hole defined by the organizer top and also engages a lock mating hole defined by each shelf that is supported by the opposing horizontal slots. When the elongated lock engages the lock mating holes, the elongated lock prevents the one or more shelves from being pulled from the opposing pairs of slots unintentionally. When not in use, the elongated lock may be stored in either of a pair of elongated lock storage holes defined by the left and right sides of the organizer top. The pair of elongated lock storage holes accommodates convenient use by both left- and right-handed persons.

III. BRIEF DESCRIPTION OF THE DRAWINGS

IV. DESCRIPTION OF AN EMBODIMENT

Figure 1:
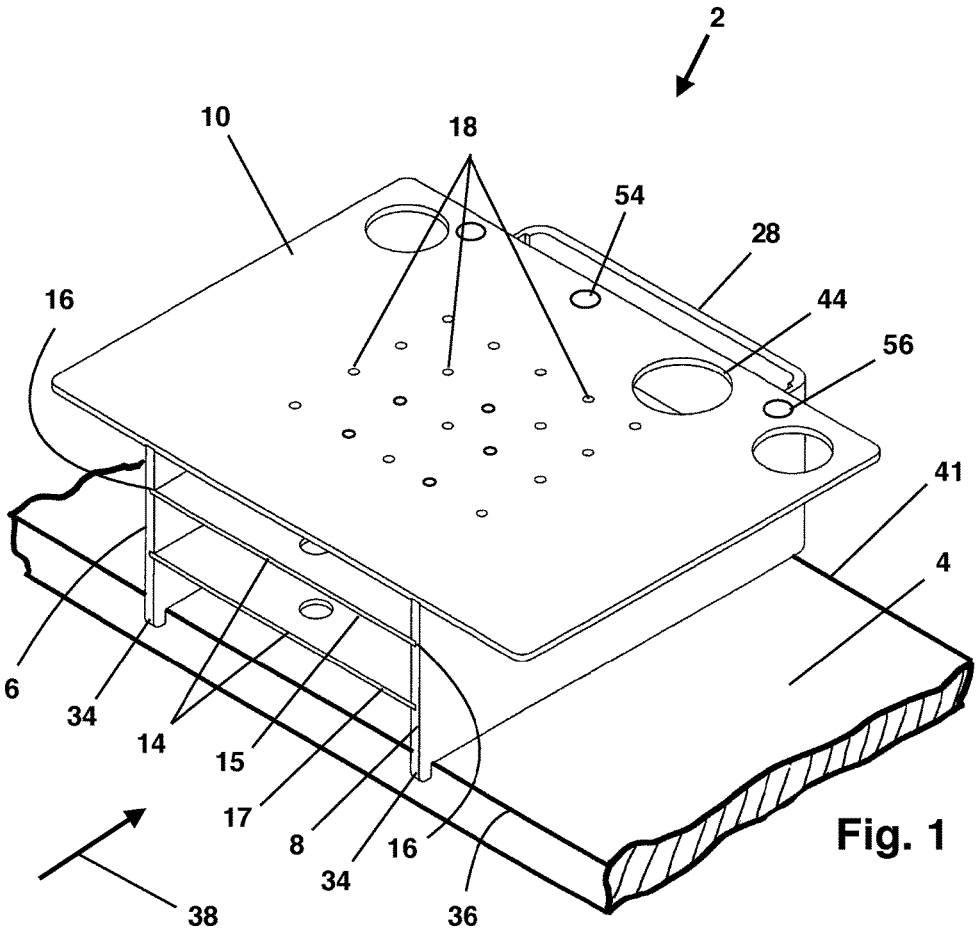
FIG. 1 is a perspective view of the organizer of the Invention.

As shown by FIG. 1, the Invention is an organizer 2 for use with an over-bed table 4. An over-bed table 4 extends over a bed, frequently in a hospital or other healthcare setting. The over-bed table 4 allows a person confined to the bed to reach article needed by the person, such as food, beverages, pharmaceuticals, reading materials, a tablet or laptop computer, office supplies, and any other article to which the person may need access. The organizer 2 allows a person confined to bed to substantially increase the working and storage surfaces available to the person.

From FIG. 1, the organizer 2 includes a left side 6 and a right side 8. When the left and right sides 6, 8 are supported by the over-bed table 4, the left and right sides 6, 8 are in an upright orientation. An organizer top 10 provides a working surface to the person confined to the bed. The organizer top 10 is attached to and supported by the left and right sides 6, 8. When the left and right sides 6, 8 are supported by the over-bed table 4, the organizer top 10 has a horizontal orientation.

Figure 2:
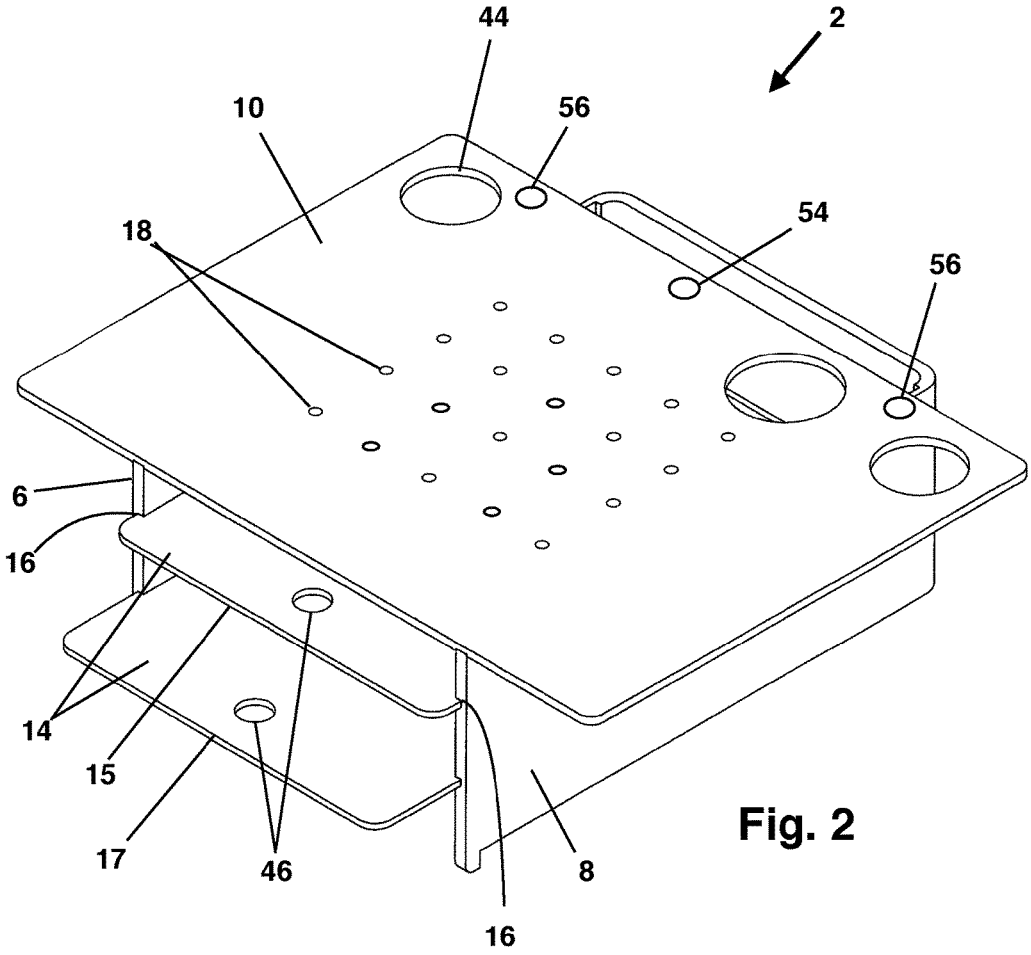
FIG. 2 is a perspective view of the organizer with two shelves partially installed.
Figure 3:
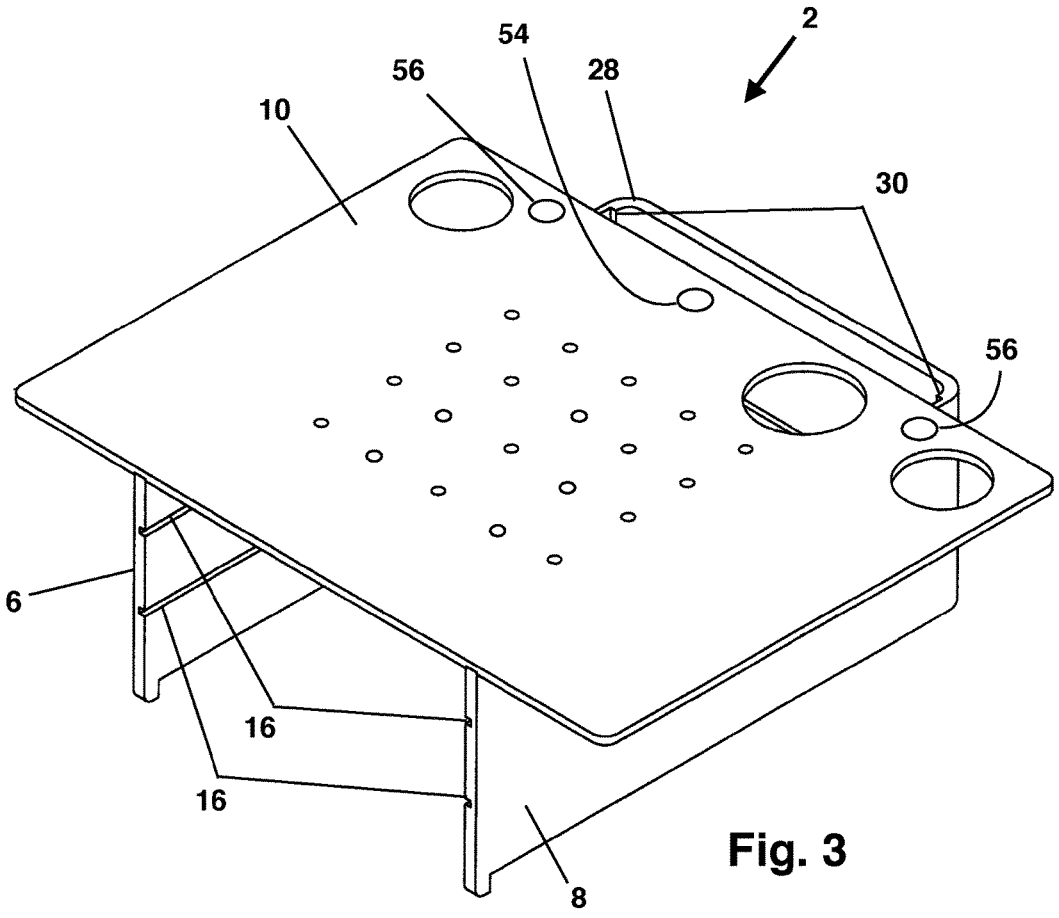
FIG. 3 is a perspective view of the organizer with the shelves removed.

From FIGS. 1, 2, 4 and 6, the organizer 2 may include one or more shelves 14. FIG. 1 shows two shelves 14, but any number of shelves 14 is contemplated by the Invention. Each shelf 14 is configured to slidably engage a pair of opposing horizontal slots 16 in the first and second sides 6, 8. FIGS. 1-3 show two pairs of opposing horizontal slots 16 in the first and second sides 6, 8, but any number of opposing pairs of horizontal slots 16 is contemplated by the Invention. FIG. 1 shows two shelves 14 fully inserted into two pairs of opposing horizontal slots 16. FIG. 2 shows two shelves 14 partially inserted into the two pairs of opposing horizontal slots 16. FIG. 3 shows the organizer 2 with the shelves 14 removed. Finger holes 46, shown by FIGS. 2, 4 and 5 and others, allow the user the readily grip a shelf 14 to install or remove the shelf 14 from the opposing horizontal slots 16.

Figure 4:
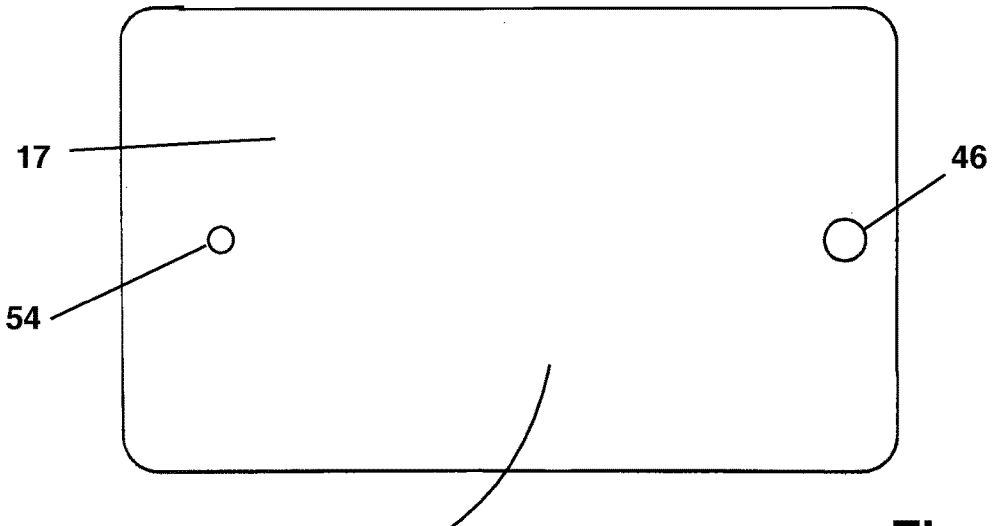
FIG. 4 is a plan view of a lower shelf.
Figure 5:
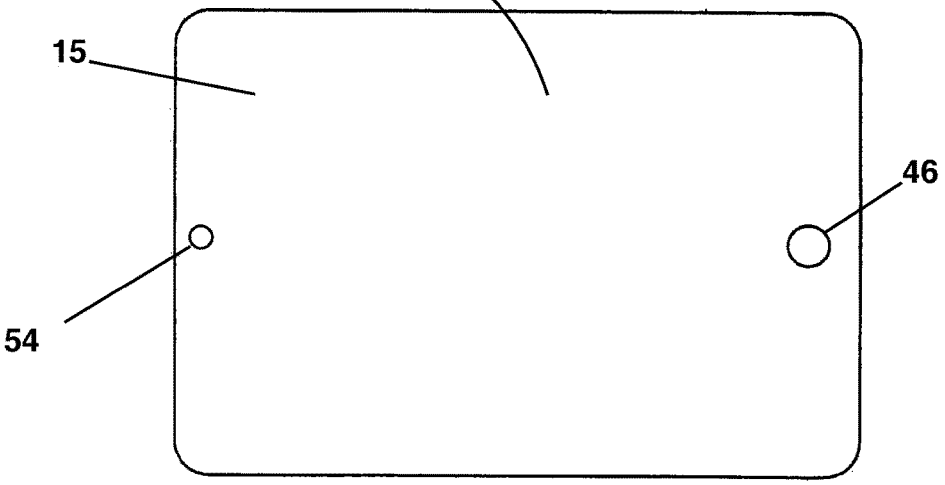
FIG. 5 is a plan view of an upper shelf.
Figure 6:
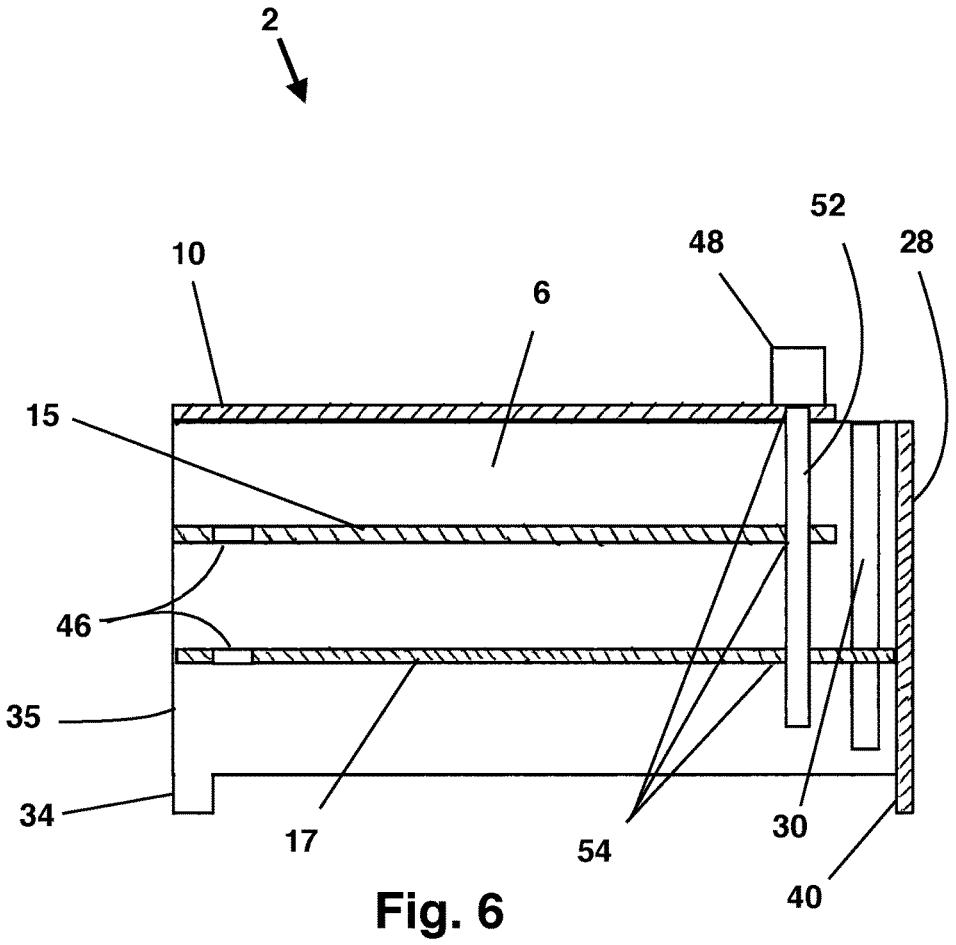
FIG. 6 is a sectional side view of the organizer with two shelves and the elongated lock.

From FIGS. 4, 5 and 6 illustrate that the shelves 14 may be of different sizes. FIG. 4 is a plan view of an upper shelf 15 and FIG. 5 is a plan view of a lower shelf 17. FIG. 6 is a sectional side view of the organizer 2 showing the upper 15 and lower 17 in position in the opposing horizontal slots 16. From FIG. 6, the lower shelf 17 extends to the back 28 of the organizer 2 while the upper shelf 15 does not reach the back 28 of the organizer 2. Items stored between the organizer top 10 and the back 28 thus are supported from below by the lower shelf 17 and hence are not lost or scattered if a person moves the organizer 2 from the over-bed table 4. The shank 52 of the elongated lock 48 selectably penetrates the lock mating holes 54 and holds the upper and lower shelves 15, 17 in a fixed position with respect to the organizer top 10. For the operation of the elongated lock 48, see the description of FIGS. 14 and 15 below.

Figure 7:
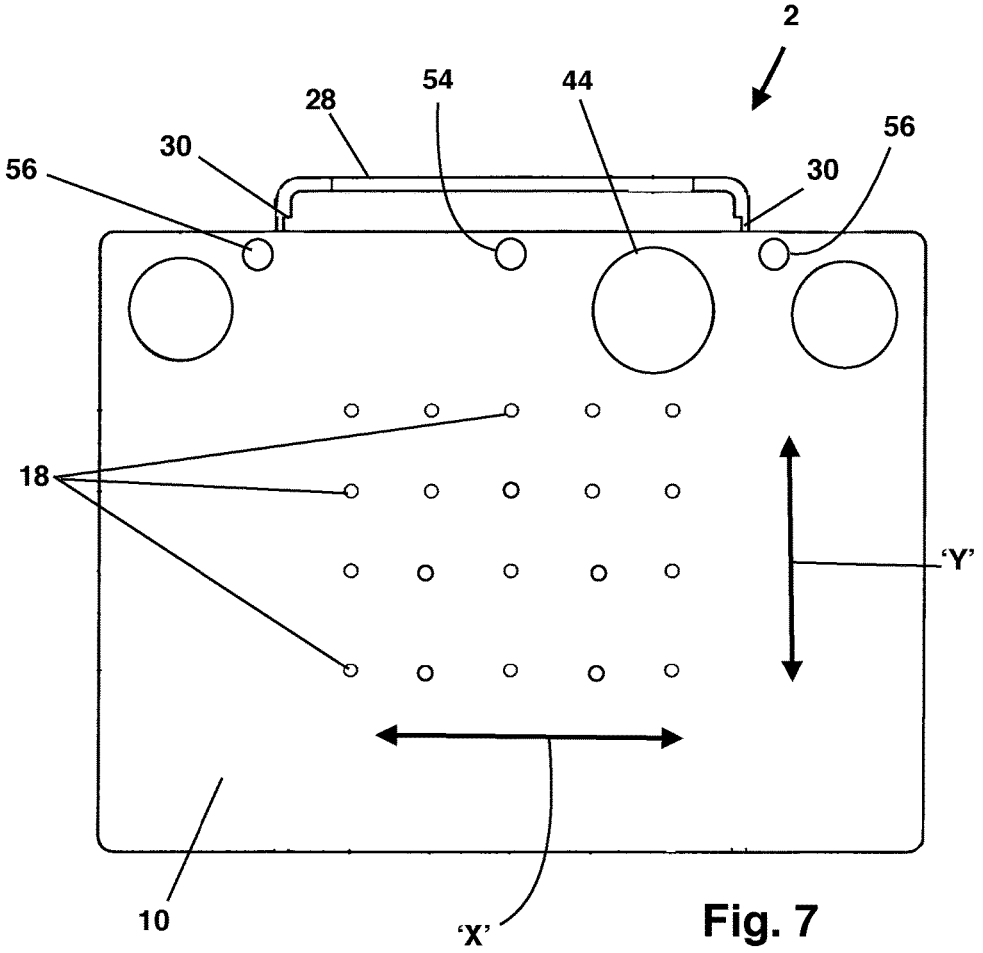
FIG. 7 is a top view of the organizer.
Figure 8:
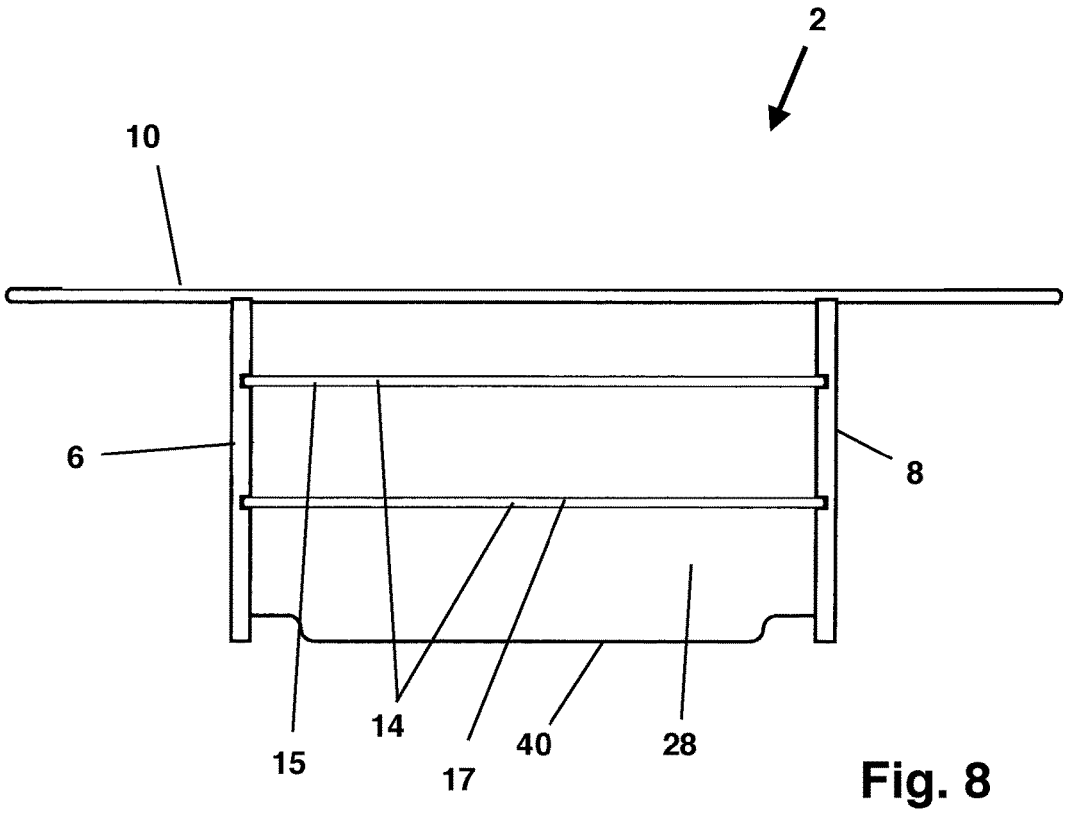
FIG. 8 is a front view of the organizer.
Figure 9:
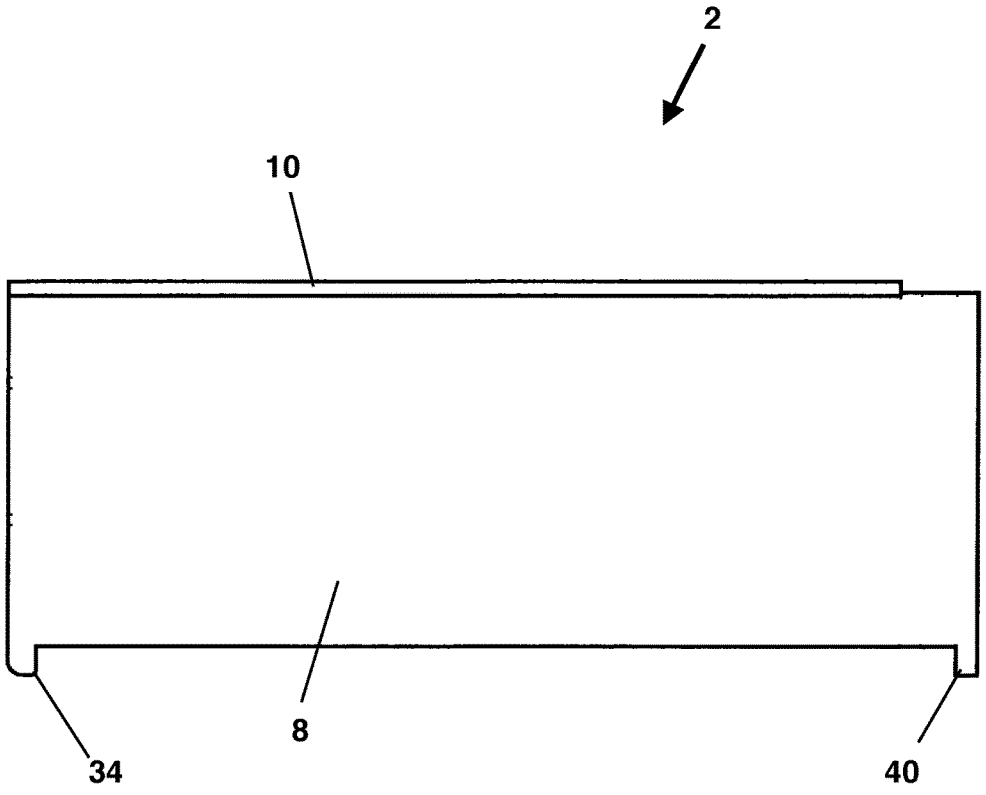
FIG. 9 is a side view of the organizer viewed from the right side.

FIGS. 7, 8 and 9 are top, front and side views, respectively of the organizer 2. From FIG. 7 and from FIGS. 1-3, 12 and 13, the organizer top 10 includes a plurality of holes 18 penetrating the portion of the organizer top 10 that is between the first and second sides 6, 8. The holes 18 are clearance holes for pins 20, shown by FIGS. 10 and 11.

Figure 10:
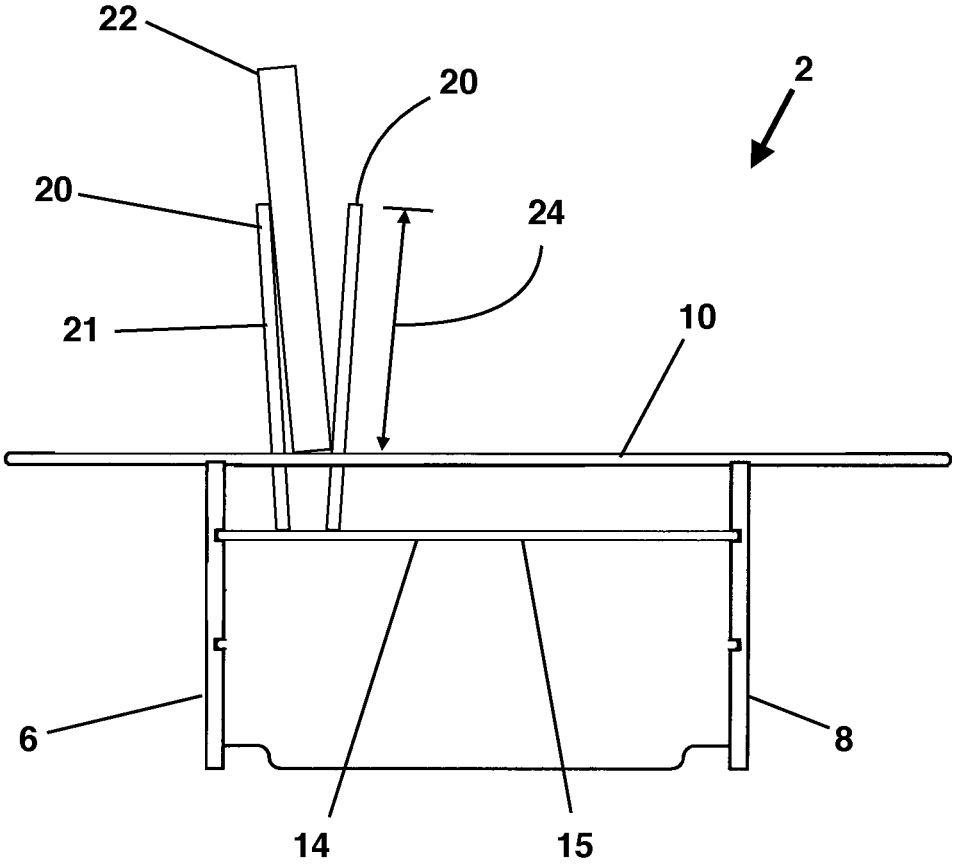
FIG. 10 is a front view of the organizer showing the operation of the pins.
Figure 11:
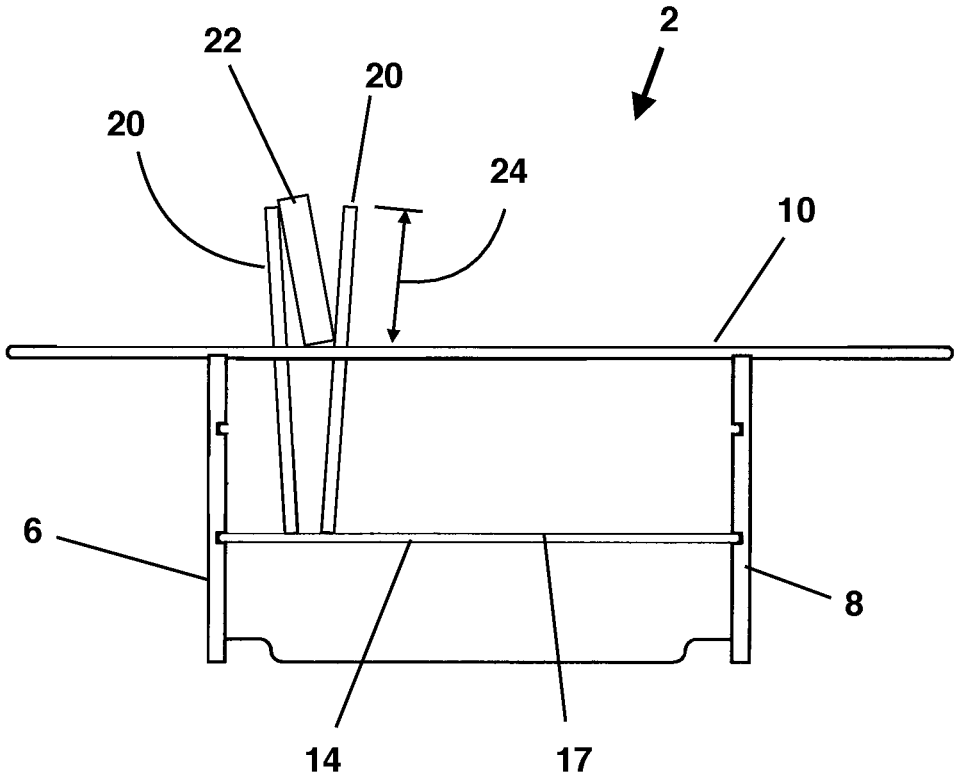
FIG. 11 is an alternative front view of the organizer showing the operation of the pins.

From FIGS. 10 and 11, pins 20 penetrate the holes 18, as selected by the user. The pins 20 may be cylindrical and in the shape of dowels. In one embodiment, a conventional pencil 21, such as a wooden pencil 21, defines a pin 20. The pins 20 may be composed of any suitable material, such as wood, metal or a polymer. The sides of a hole 18 support the pin 20 in a generally upright position. Each pin 20 has a length. The length of the pin 20 is selected so that the pin 20 extends above the organizer top 10 by an amount 24 sufficient to support an object to be supported 22 in a generally upright position.

The user may configure the organizer 2 to support the object 22 in an upright position in any desired orientation by selecting holes 18 having appropriate locations and by inserting pins 20 in the selected holes 18. Because the holes 18 are disposed on the organizer top 10 generally in a grid pattern having an 'X' and a 'Y' direction, shown by FIG. 7, the pins 20 may be located to orient the object to be supported 22 parallel to the 'X' direction, parallel to the 'Y' direction, or oblique to the 'X' or 'Y' directions. In general, at least three pins 20 will be needed to support an object to be supported 22, although four or more pins 20 may be used.

FIGS. 10 and 11 also illustrate that when a pin 20 is inserted through the hole 18, a shelf 14 stops downward movement of the pin 20 if the shelf 14 is disposed in an opposing pair of horizontal slots 16. Of course, an article located on the shelf 14 also may limit the downward movement of the pin. The vertical location of the shelf 14, or of an article on the shelf 14, therefore determines the amount 24 by which the pin 20 will extend above the organizer top 10. From FIG. 11 if the lower shelf 17 stops the pin 20, a lesser amount 24 of the pin 20 will extend above the organizer top 10. This arrangement is suitable for a smaller object to be supported 22.

Figure 12:
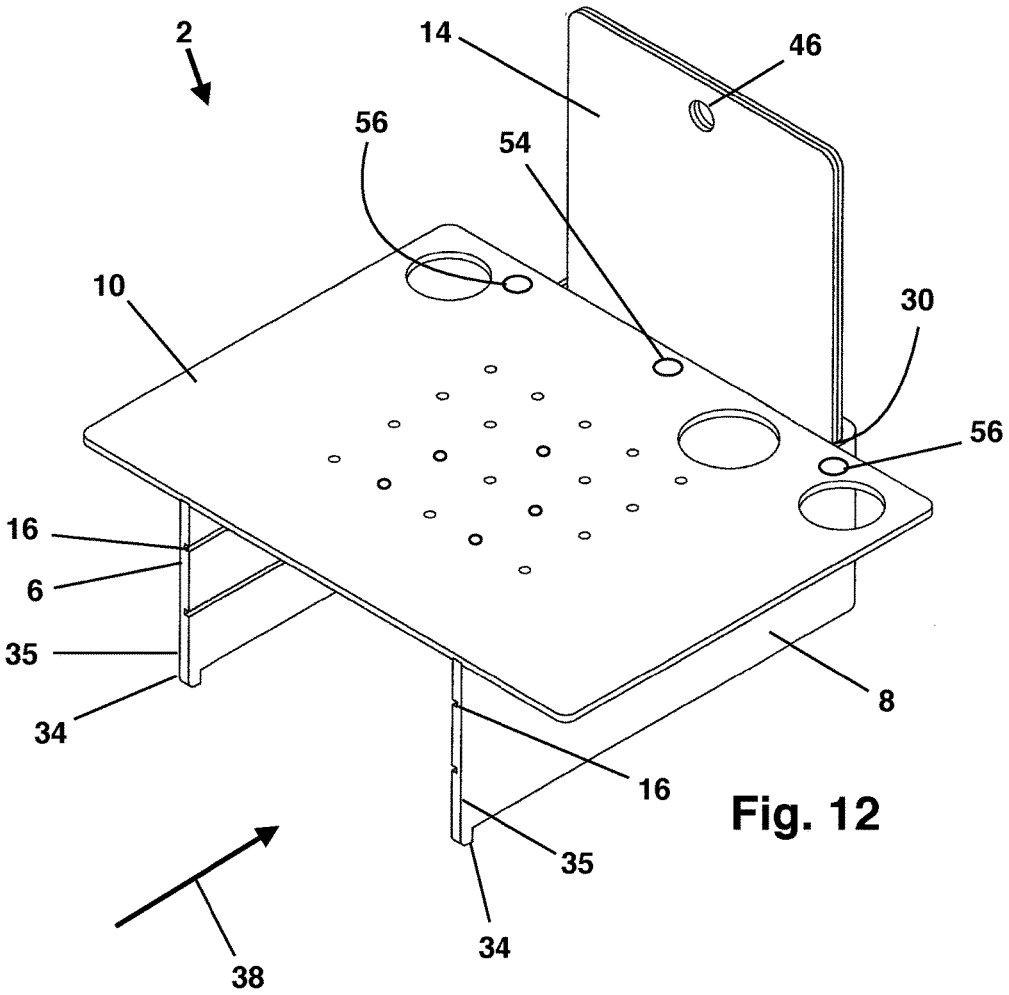
FIG. 12 is a perspective view showing two shelves of equal size in the opposing vertical storage slots.
Figure 13:
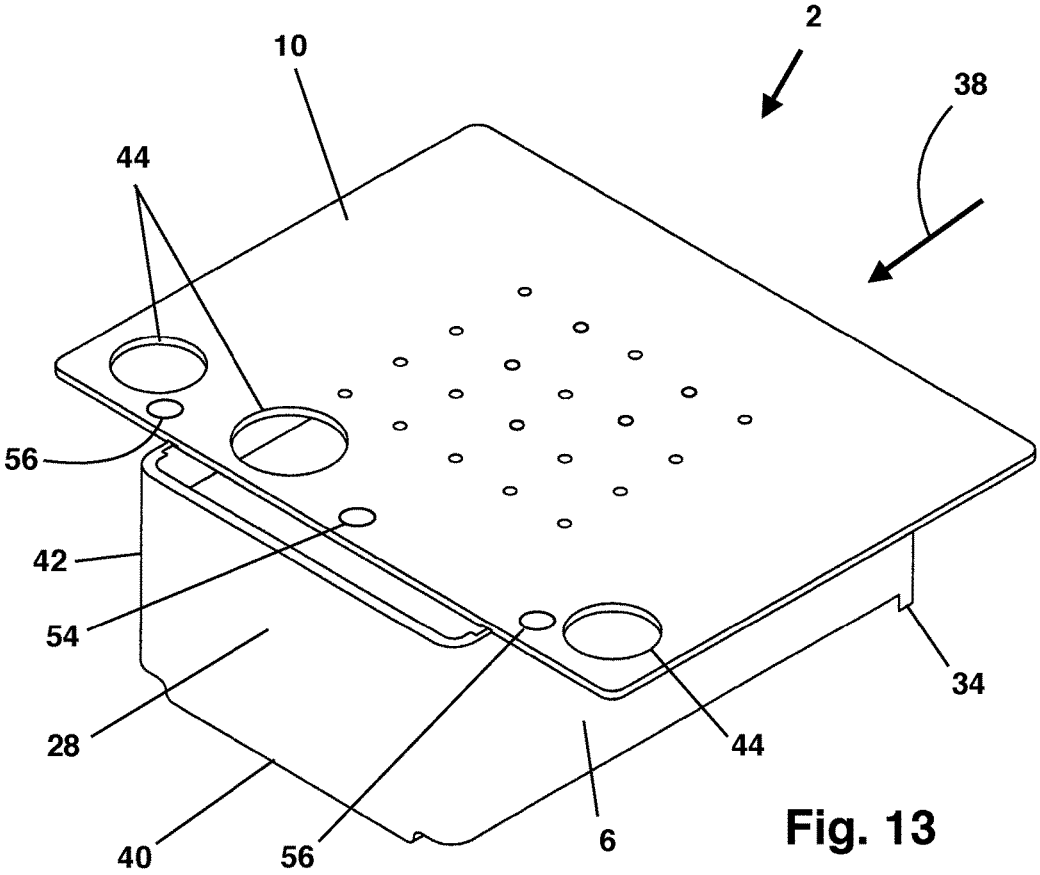
FIG. 13 is a perspective view of the back of the organizer.

FIGS. 12 and 13 illustrate the structure and function of the back 28 of the organizer 2. The back 28 joins the left and right sides 6, 8. The back 28 is in a spaced apart relation to the organizer top 10 and does not directly support the organizer top 10. The left and right sides 6, 8 define an opposing pair of vertical storage slots 30 located between the organizer top 10 and the back 28. The opposing pair of vertical storage slots 30 is configured to receive and store the one or more shelves 14 in a vertical position when the shelves 14 are not in use, all as shown by FIG. 12. Although FIG. 12 shows the shelves 14 stored in the opposing vertical storage slots 30 as being the same size, the shelves 14 may be an upper shelf 15 and lower shelf 17 of different sizes, as shown by FIGS. 4 and 5.

Also from FIG. 12, the front ends 35 of the left and right sides 6, 8 together define a front stop 34. The front stop 34 is configured to engage the front edge 36 of the over-bed table 4, as shown by FIG. 1, when the over-bed table 4 supports the organizer 2. The front stop 34 prevents the organizer 2 from moving in a first direction 38, shown by FIG. 12, away from the person confined to bed.

From FIG. 13, the back 28 defines a rear stop 40. The rear stop 40 is configured to engage the rear edge 41 of the over-bed table 4, shown by FIG. 1, and to prevent the organizer 2 from moving in a direction opposite to the first direction 38 toward the person confined to bed.

The back 28 and the left and right sides 6, 8 may be composed of a single piece of material and may feature bends at the junction between the back 28 and the left and right sides 6, 8 to define a U-shaped wrap 42, as shown by FIG. 13.

From FIGS. 1-3, 7, 12 and 13, the organizer top 10 may include one or more cup openings 44 configured to receive and retain a cup. A cup retained in a cup opening 44 may store pins 20 when the pins 20 are not disposed in the holes 18.

The organizer 2 may be composed of any suitable material including metal, polymer or wood, but acrylic, particularly clear acrylic, is believed to be suitable. Clear acrylic allows the person confined to bed to see the objects contained within the organizer 2. The acrylic also may be readily disinfected in the healthcare setting.

Figure 14:
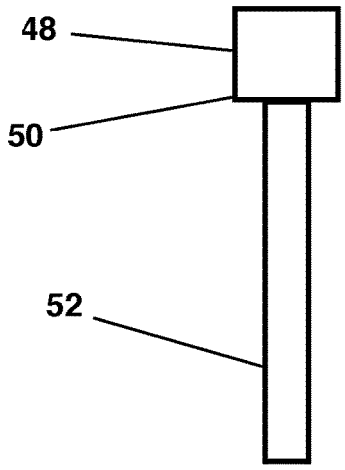
FIG. 14 is a side view of an elongated lock.
Figure 15:
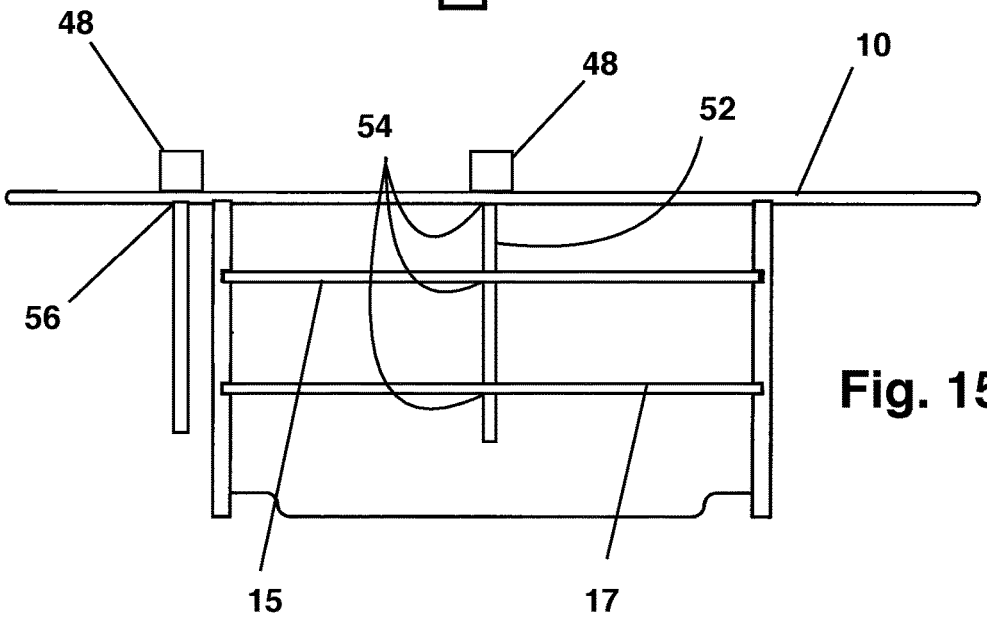
FIG. 15 is a front view of the organizer with the elongated lock in position.

If a user inadvertently pulls a shelf 14 from the opposing horizontal slots 16 defined by the left and right sides 6, 8, any pins 20 supported by the shelf 14 may collapse. To avoid this result and as shown by FIGS. 14 and 15, the organizer 2 may feature an elongated lock 48 to prevent the unintentional movement of a shelf 14 with respect to the organizer top 10. From FIG. 14, the elongated lock features a elongated lock stop 50. The elongated lock stop 50 provides a grip by which a user may manipulate the elongated lock 48. The elongated lock 48 also features a elongated lock shank 52. From FIG. 16, the elongated lock shank 52 selectably engages a lock mating hole 54 penetrating the organizer top 10 (see FIGS. 1-3, 6, 7, 12, 13, and 15) and also penetrates a lock mating hole 54 in the shelf 14 (see FIGS. 4-6 and 15). The elongated lock 48 ties the shelf 14 to the organizer top 10, preventing inadvertent removal of the shelf 14 from the opposing horizontal slots 16 and thus preventing unintentional collapse of the pins 20 and an object 22 supported by the pins 20. The organizer top 10 may define one or more elongated lock storage holes 56 (see FIGS. 1-3, 7, 12, 13, and 15). The elongated lock storage holes 56 provide a location where the elongated lock 48 may be conveniently stored when not in use.

The following is a list of the numbered elements from the drawings and specification.

organizer 2
over-bed table 4
left side 6
right side 8
organizer top 10
shelf 14
upper shelf 15
pair of opposing horizontal slots 16
lower shelf 17
plurality of holes 18
pin 20
pencil 21
object to be supported 22
amount 24
back 28
opposing pair of vertical storage slots 30
front stop 34
front end 35
front edge of the over-bed table 36
first direction 38
rear stop 40
rear edge of the over-bed table 41
U-shaped wrap 42
cup openings 44
finger hole 46
elongated lock 48
elongated lock stop 50
elongated lock shank 52
lock mating hole 54
elongated lock storage hole 56

I claim:

1. An organizer for use with an over-bed table, the organizer comprising:

a. a left side and a right side, said left and right sides being in a spaced apart relation, said left side and said right side being configured to be supported in an upright position by the over-bed table;

b. an organizer top attached directly to and supported by a top surface of said left side and a top surface of said right side, said organizer top having a horizontal orientation when said left side and said right side are supported by the over-bed table;

c. at least one shelf, said at least one shelf being configured for a selectable engagement with said left side and said right side so that said at least one shelf is selectably disposed between said left and right sides in said horizontal orientation when said at least one shelf is in said selectable engagement therebetween;

d. a plurality of holes formed in said organizer top, the plurality of holes being configured to receive a plurality of pins, each of said plurality of holes being configured to receive a corresponding pin from said plurality of pins to support the corresponding pin from said plurality of pins in a generally upright position with each pin extending above said organizer top when said pins penetrate said holes, whereby when said pins penetrate said plurality of holes, said pins can support an object in a generally upright position on said organizer top;

e. a back, said back joining said left side and said right side, said back being in said upright position when said left and rights sides are supported by the over-bed table wherein said organizer top is in a spaced apart relation to said back and wherein said back does not directly support said organizer top;

f. a pair of opposing vertical storage slots, a first slot from said pair of opposing vertical storage slots being defined in said left side, a second slot from said pair of opposing vertical slots being defined in said right side, said pair of opposing vertical storage slots being located between said organizer top and said back, said pair of opposing vertical storage slots being configured to receive and support said at least one shelf, said pair of opposing vertical storage slots being vertically oriented when said left and right sides are supported by the over-bed table, whereby said at least one shelf can be stored vertically in said pair of opposing vertical storage slots between the organizer top and the back.

2. The organizer of claim 1 further comprising: said pins.

3. The organizer of claim 2 wherein each of said plurality of pins and said organizer top are configured so that said at least one shelf will limit a movement of each of said pins through each of said plurality of holes when said at least one shelf is in said selectable engagement with said right side and said left side.

4. The organizer of claim 3 wherein said left side and said right side define a plurality of pairs of opposing horizontal slots, said selectable engagement of said at least one shelf with said right and left sides comprises slidably engaging said at least one shelf within a corresponding pair of horizontal slots from said plurality of pairs of opposing horizontal slots.

5. The organizer of claim 3 wherein each of said pins has a length, said length being sufficient so that said pins extend above said organizer top by an amount sufficient to support an object in a generally upright position when said pins penetrate said holes and said at least one shelf limits the penetration of said pins with said plurality of said holes.

6. The organizer of claim 3, wherein said left side and said right side define a plurality of pairs of opposing horizontal slots, whereby a user can select an amount by which said pin extend above said organizer top by inserting said at least one shelf into a corresponding pair of horizontal slots from said plurality of pairs of opposing horizontal slots.

7. The organizer of claim 2 wherein each of said pins is composed of a wood, a metal, or a polymer.

8. The organizer of claim 2 wherein each of said pins is a pencil.

9. The organizer of claim 1, the organizer further comprising: an elongated lock, said elongated lock having an elongated shank, said organizer top and said at least one shelf each defining a lock mating hole, said shank of said elongated lock being configured to simultaneously engage said lock mating hole of said organizer top and said lock mating hole of said at least one shelf, whereby said shank prevents a movement of said at least one shelf with respect to said organizer top when said shank engages said lock mating holes.

10. The organizer of claim 9 wherein said organizer top defines at least one elongated lock storage hole, said elongated lock not penetrating said lock mating hole of said at least one shelf when said elongated lock penetrates said at least one elongated lock storage hole.

11. The organizer of claim 1 wherein said left side and said right side define a pair of opposing horizontal slots, said selectable engagement of said at least one shelf with said right and left sides comprises slidably engaging said at least one shelf with said pair of horizontal slots, said at least one shelf being horizontally oriented when said at least one shelf is in engagement with said horizontal slots.

12. The organizer of claim 1 wherein said left and right sides each defines a front stop, each front stop depending from a front end of said left and right sides respectively, each front stop being configured to engage a front edge of the over-bed table when said left and right sides are supported by the over-bed table to prevent movement of the organizer in a first direction with respect to the over-bed table.

13. The organizer of claim 12 wherein said back defines a rear stop, said rear stop being configured to engage a rear edge of the over-bed table when the left and right sides are supported by the over-bed table to prevent movement of the organizer in a second direction opposite to said first direction with respect to the over-bed table.

14. The organizer of claim 1, further comprising: one or more cup openings defined by said organizer top, each of said one or more cup openings being configured to receive and retain a cup.

15. The organizer of claim 1 wherein said left and right sides are joined to define said back, wherein said left side, said right side, and said back combined define a U-shape.

16. The organizer of claim 1 wherein said back, said left and right sides, and said organizer top are composed of an acrylic.

17. The organizer of claim 16 wherein said acrylic is transparent.

* * * * *